US007411357B2

(12) United States Patent
Lee

(10) Patent No.: US 7,411,357 B2
(45) Date of Patent: Aug. 12, 2008

(54) LIQUID CRYSTAL AND DEVICE OF DRIVING LIGHT SOURCE THEREFOR

(75) Inventor: Sang-Yong Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 42 days.

(21) Appl. No.: 11/003,622

(22) Filed: Dec. 3, 2004

(65) Prior Publication Data

US 2005/0146291 A1 Jul. 7, 2005

(30) Foreign Application Priority Data

Dec. 4, 2003 (KR) ..... 10-2003-0087591

(51) Int. Cl.
*H05B 41/16* (2006.01)

(52) U.S. Cl. ..... 315/277; 315/312; 315/291; 315/224; 345/102

(58) Field of Classification Search ..... 315/276–278, 315/274, 282, 312, 291, DIG. 2, 224; 345/102
See application file for complete search history.

(56) References Cited

U.S. PATENT DOCUMENTS

| | | | | |
|---|---|---|---|---|
| 6,417,833 | B1 * | 7/2002 | Takemoto | 315/169.4 |
| 6,709,122 | B2 * | 3/2004 | Adachi et al. | 362/27 |
| 6,936,975 | B2 * | 8/2005 | Lin et al. | 315/224 |
| 6,979,957 | B2 * | 12/2005 | Lee et al. | 315/308 |
| 7,187,139 | B2 * | 3/2007 | Jin | 315/274 |
| 2003/0214478 | A1 * | 11/2003 | Yoo et al. | 345/102 |
| 2004/0155853 | A1 * | 8/2004 | Lin | 345/102 |
| 2005/0242789 | A1 * | 11/2005 | Kang | 315/291 |

* cited by examiner

*Primary Examiner*—Douglas W. Owens
*Assistant Examiner*—Ephrem Alemu
(74) *Attorney, Agent, or Firm*—Cantor Colburn LLP

(57) ABSTRACT

A device of driving a plurality of lamps is provided, which includes: a transforming unit supplying driving voltages having inverted phases to adjacent lamps; and an inverter controlling the transforming unit.

15 Claims, 6 Drawing Sheets

LIQUID CRYSTAL AND DEVICE OF DRIVING LIGHT SOURCE THEREFOR

This application claims priority to Korean Patent Application No. 10-2003-0087591, filed on Dec. 4, 2003 and all the benefits accruing therefrom under 35 U.S.C. § 119, and the contents of which in its entirety are herein incorporated by reference.

BACKGROUND OF THE INVENTION (a) Field of the Invention

The present invention relates to a liquid crystal display and a device of driving a light source therefor.

(b) Description of Related Art

Display devices used for monitors of computers and television sets generally include self-emitting display devices such as organic light emitting displays (OLEDs), vacuum fluorescent displays (VFDs), field emission displays (FEDs), and plasma panel displays (PDPs), and non-emitting display devices such as liquid crystal displays (LCDs) requiring external light source.

An LCD includes two panels provided with field-generating electrodes and a liquid crystal (LC) layer having dielectric anisotropy and interposed therebetween. The field-generating electrodes that are supplied with electric voltages generate electric field across the LC layer, and the light transmittance of the liquid crystal layer varies depending on the strength of the applied field, which can be controlled by the applied voltages. Accordingly, desired images are displayed by adjusting the applied voltages.

The light for an LCD is provided by lamps equipped at the LCD or may be a natural light. When employing the lamps, the brightness on a screen of the LCD is usually adjusted by regulating the ratio of on and off durations of the lamps or regulating the current flowing in the lamps.

The lamps for the LCDs usually include fluorescent lamps driven by an inverter. The inverter converts DC voltage into AC voltage and applies the AC voltage to the lamps to be turned on. The inverter adjusts luminance of the lamps according to a luminance control signal to control the luminance of the LCD. In addition, the inverter feedback controls the voltages applied to the lamps based on the currents of the lamps.

Recently, an external electrode fluorescent lamp (EEFL) receives attention as a substitute of a cold cathode fluorescent lamp (CCFL) since EEFL is relatively cheap and facilitates the parallel driving. In detail, EEFL includes external electrodes attached at both ends of a discharge tube and thus the external electrodes and the discharge tube play a role of ballast capacitors, thereby requiring no separate ballast capacitor, which is necessary for CCFL having inner electrodes. Accordingly, the parallel driving of EEFL is easy.

Since EEFL has a symmetrical structure that the ballast capacitors are disposed at both ends of the tubes, the electrodes at the both ends of the tube are required to be supplied with equal voltages, while the voltage difference between the electrodes are required for generating a current in the tube. Accordingly, so called floating type driving that applies two voltages having equal magnitude and opposite polarities to the electrodes is usually employed. In other words, two voltages having a phase difference of 180 degrees are applied to the opposite electrodes.

In order to generate such voltages, a secondary coil of a transformer for generating voltages for driving the lamps is usually divided into two equivalent sub-coils and the node between the sub-coils is grounded via resistors. The inverter performs the above-described feedback control based on the current flowing in one the two sub-coils.

However, since adjacent lamps are supplied with the same periodical voltages that may cause constructive electromagnetic interference therebetween and may interfere the electric field applied in the LC layer.

SUMMARY OF THE INVENTION

A device of driving a plurality of lamps is provided, which includes: a transforming unit supplying driving voltages having inverted phases to adjacent lamps; and an inverter controlling the transforming unit.

The transforming unit may include: a first transformer including a primary coil connected to the inverter and a secondary coil connected to a first lamp; and a second transformer including a primary coil connected to the inverter and a secondary coil connected to a second lamp.

The inverter may supply voltages having inverted phases to the first and the second transformers.

The secondary coil of the first transformer may be connected to the second lamp and the secondary coil of the second transformer may be connected to the first lamp. Alternatively, the secondary coil of the first transformer may be connected across the first lamp and the secondary coil of the second transformer may be connected across the second lamp.

The device may further include: a third transformer including a primary coil connected to the inverter and a secondary coil connected to the first lamp; and a fourth transformer including a primary coil connected to the inverter and a secondary coil connected to the second lamp.

The secondary coils of the first to the fourth transformers may be connected to a ground via resistors.

The primary coils of the first and the third transformers may be connected to each other via a first capacitor and the primary coils of the second and the fourth transformers may be connected to each other via a second capacitor.

The primary coils of the first and the second transformers may be connected to each other via a capacitor.

The device may further include a current sensor detecting a current flowing in the transforming unit and providing current information for the inverter.

The current sensor may include a plurality of first to fourth resistors.

The transforming unit may include: a first transformer including a primary coil connected to the inverter and a secondary coil having a first terminal connected to a first lamp and a second terminal connected to the first resistor; a second transformer including a primary coil connected to the inverter and a secondary coil having a first terminal connected to the first lamp and a second terminal connected to the second resistor; a third transformer including a primary coil connected to the inverter and a secondary coil having a first terminal connected to a second lamp and a second terminal connected to the third resistor; a fourth transformer including a primary coil connected to the inverter and a secondary coil having a first terminal connected to the second lamp and a second terminal connected to the fourth resistor; a first capacitor connected to the primary coils of the first and the second transformers; and a second capacitor connected to the primary coils of the third and the fourth transformers.

The first to the fourth resistors may have grounded terminals.

The device may further include a luminance sensor detecting a luminance of the lamps and providing luminance information for the inverter.

The lamps may include EEFL.

A liquid crystal display is provided, which includes: a plurality of pixels arranged in a matrix; a plurality of lamps supplying light to the pixels based on driving voltages; a transforming unit supplying the driving voltages having inverted phases to adjacent lamps; an inverter controlling the transforming unit; and a current sensor detecting a current flowing in the transforming unit and providing current information for the inverter.

The transforming unit may include: a first transformer including a primary coil connected to the inverter and a secondary coil connected to a first lamp; and a second transformer including a primary coil connected to the inverter and a secondary coil connected to a second lamp.

A liquid crystal display is provided, which includes: a plurality of pixels arranged in a matrix; a plurality of lamps supplying light to the pixels based on driving voltages; a transforming unit supplying the driving voltages having inverted phases to adjacent lamps; an inverter controlling the transforming unit; and a luminance sensor detecting a luminance of the lamps and providing luminance information for the inverter.

The transforming unit may include: a first transformer including a primary coil connected to the inverter and a secondary coil connected across a first lamp; and a second transformer including a primary coil connected to the inverter and a secondary coil connected across a second lamp.

Alternatively, the transforming unit may include: a first transformer including a primary coil connected to the inverter and a secondary coil connected to first and second lamps; and a second transformer including a primary coil connected to the inverter and a secondary coil connected to the first and the second lamps.

The luminance sensor may be disposed opposite the pixels with respect to the lamps and may be disposed near a center of the lamps.

The lamps may include EEFL.

BRIEF DESCRIPTION OF THE DRAWINGS

The present invention will become more apparent by describing preferred embodiments thereof in detail with reference to the accompanying drawings in which.

DETAILED DESCRIPTION OF EMBODIMENTS

Figure 1:
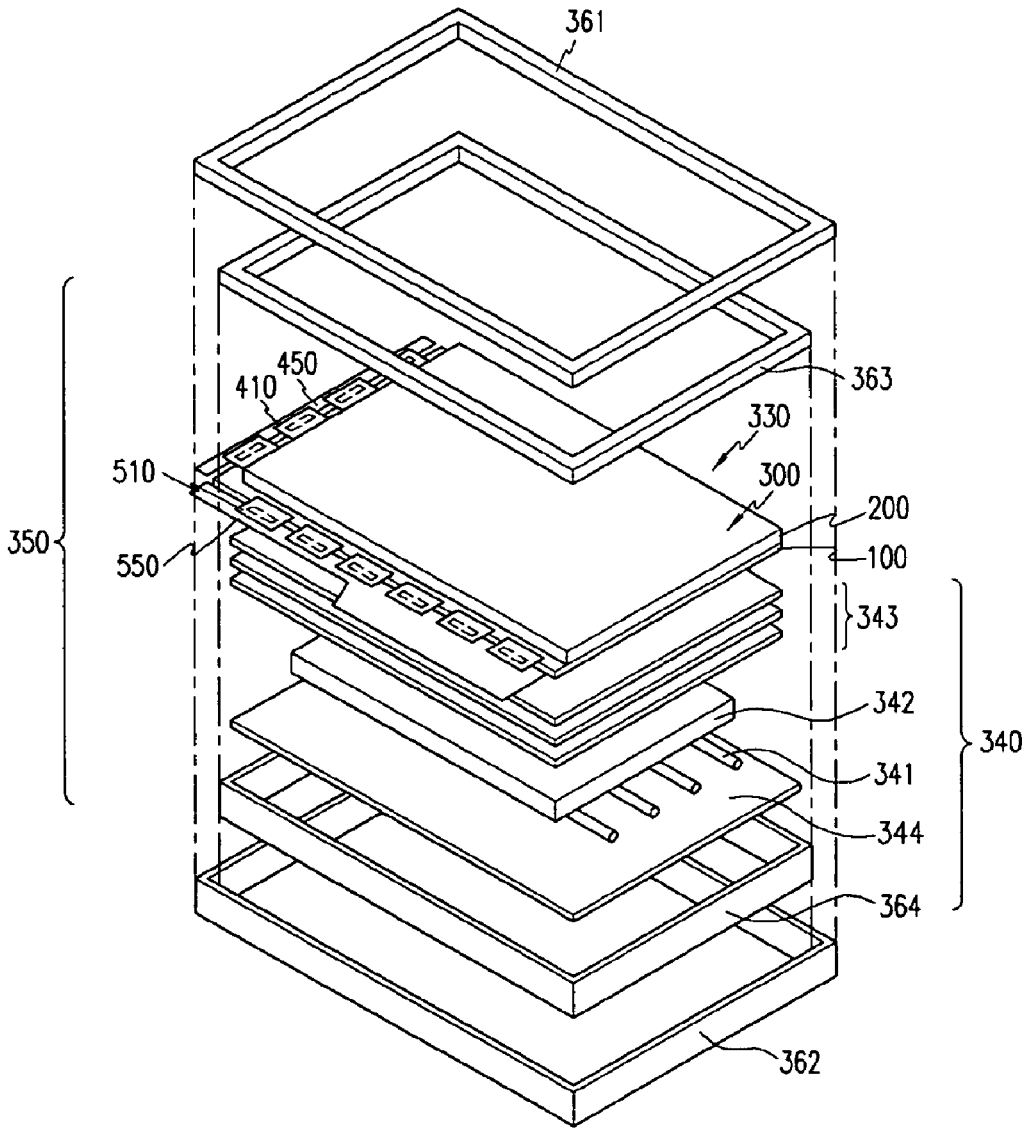
FIG. 1 is an exploded perspective view of an LCD according to an embodiment of the present invention.

The present invention now will be described more fully hereinafter with reference to the accompanying drawings, in which preferred embodiments of the inventions invention are shown.

In the drawings, the thickness of layers and regions are exaggerated for clarity. Like numerals refer to like elements throughout. It will be understood that when an element such as a layer, film, region, substrate or panel is referred to as being "on" another element, it can be directly on the other element or intervening elements may also be present. In contrast, when an element is referred to as being "directly on" another element, there are no intervening elements present.

Then, liquid crystal displays, apparatus and method of driving a light source for a liquid crystal display according to embodiments of the present invention will be described with reference to the accompanying drawings.

A liquid crystal display according to an embodiment of the present invention is described in detail with reference to FIGS. 1-3.

Figure 2:
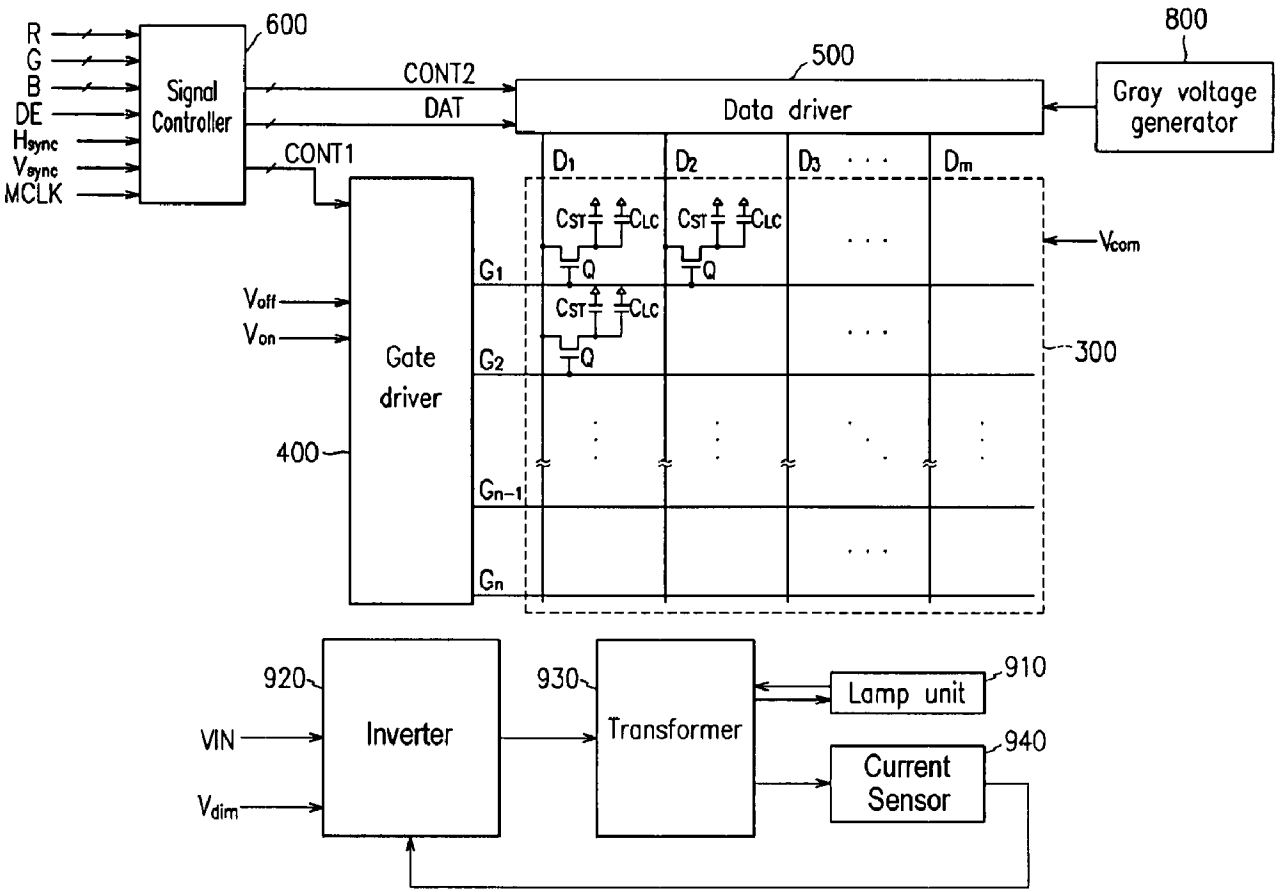
FIG. 2 is a block diagram of a part of the LCD shown in FIG. 1.
Figure 3:
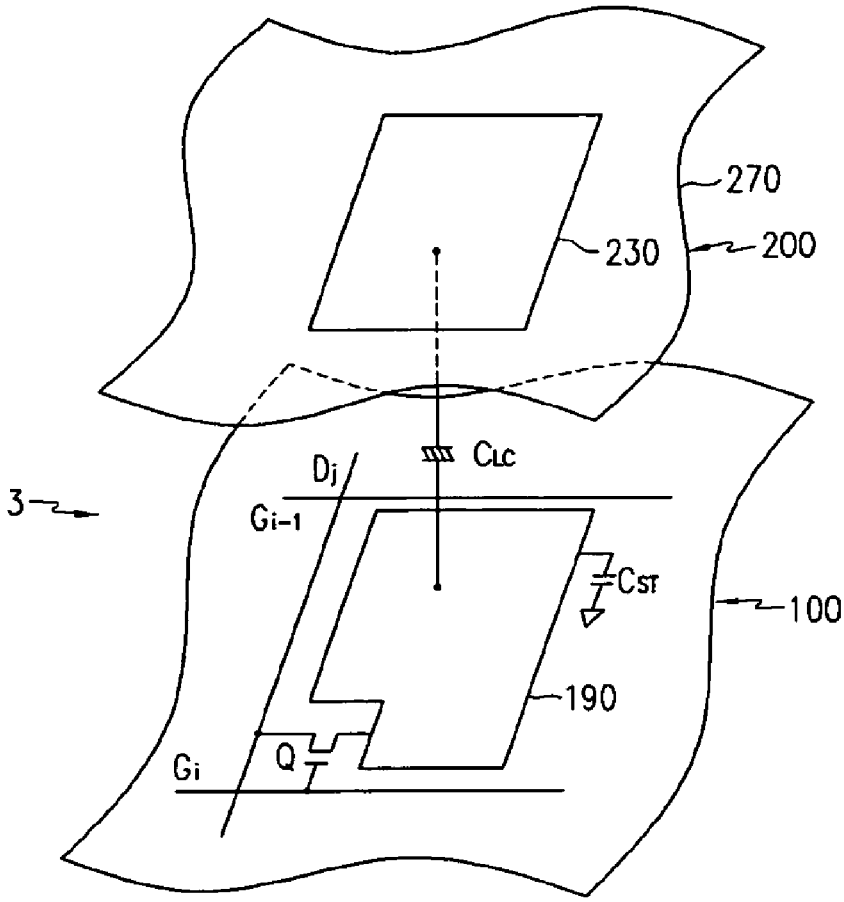
FIG. 3 is an equivalent circuit diagram of a pixel of the LCD shown in FIG. 1.

FIG. 1 is an exploded perspective view of an LCD according to an embodiment of the present invention, FIG. 2 is a block diagram of a part of the LCD shown in FIG. 1, and FIG. 3 is an equivalent circuit diagram of a pixel of the LCD shown in FIG. 1.

Referring to FIG. 1, the LCD according to an embodiment of the present invention includes a display module 350 including a display unit 330 and a backlight unit 340, and a pair of front and rear cases 361 and 362, a chassis 363 and a mold frame 364 containing and fixing the LC module 350.

The display unit 330 includes a display panel assembly 300, a plurality of gate tape carrier packages (TCPs) or chip-on-film (COF) type packages 410 and a plurality of data TCPs 510 attached to the display panel assembly 300, and a gate printed circuit board (PCB) 450 and a data PCB 550 attached to the gate and the data TCPs 410 and 510, respectively.

The backlight unit 340 includes lamps 341 disposed behind the display panel assembly 300, a spread plate 342 and optical sheets 343 disposed between the panel assembly 300 and the lamps 341. The spread plate 342 guides and diffuses light from the lamps 341 to the panel assembly 300. The backlight unit also includes a reflector 344 disposed under the lamps 341 and reflecting the light from the lamps 341 toward the panel assembly 300.

The lamps 341 are EEFL (external electrode fluorescent lamp).

Referring to FIG. 2, the LCD also includes a gate driver 400 and a data driver 500 connected to the display panel assembly 300, a gray voltage generator 800 connected to the data driver 500, a transforming unit 930 connected to a lamp unit 910 including the lamps 341, an inverter 920 connected to the transforming unit 930, a current sensor 940 connected to the transforming unit 930 and the inverter 920, and a signal controller 600 controlling the above-described elements. The inverter 920, the transforming unit 930, and the current sensor 940 may be disposed on a stand-alone inverter PCB (not shown), or on the gate PCB 450 or the data PCB 550.

The display panel assembly 300 includes a lower panel 100, an upper panel 200, and a liquid crystal layer 3 interposed therebetween as shown in FIG. 3. The display panel assembly 300 it includes a plurality of display signal lines G1-Gn and D1-Dm and a plurality of pixels connected thereto and arranged substantially in a matrix in circuital view.

The display signal lines G1-Gn and D1-Dm are disposed on the lower panel 100 and include a plurality of gate lines G1-Gn transmitting gate signals (also referred to as "scanning signals") and a plurality of data lines D1-Dm transmitting data signals. The gate lines G1-Gn extend substantially in a row direction and are substantially parallel to each other, while the data lines D1-Dm extend substantially in a column direction and are substantially parallel to each other.

Each pixel includes a switching element Q connected to the display signal lines G1-Gn and D1-Dm, and an LC capacitor $C_{LC}$ and a storage capacitor $C_{ST}$ that are connected to the switching element Q. The storage capacitor $C_{ST}$ may be omitted if unnecessary.

The switching element Q that may be implemented as a TFT is disposed on the lower panel 100. The switching element Q has three terminals: a control terminal connected to one of the gate lines G1-Gn; an input terminal connected to one of the data lines D1-Dm; and an output terminal connected to the LC capacitor $C_{LC}$ and the storage capacitor $C_{ST}$.

The LC capacitor $C_{LC}$ includes a pixel electrode 190 provided on the lower panel 100 and a common electrode 270 provided on an upper panel 200 as two terminals. The LC layer 3 disposed between the two electrodes 190 and 270 functions as dielectric of the LC capacitor $C_{LC}$. The pixel electrode 190 is connected to the switching element Q, and the common electrode 270 is supplied with a common voltage Vcom and covers an entire surface of the upper panel 200. Unlike FIG. 2, the common electrode 270 may be provided on the lower panel 100, and both electrodes 190 and 270 may have shapes of bars or stripes.

The storage capacitor $C_{ST}$ is an auxiliary capacitor for the LC capacitor $C_{LC}$. The storage capacitor $C_{ST}$ includes the pixel electrode 190 and a separate signal line, which is provided on the lower panel 100, overlaps the pixel electrode 190 via an insulator, and is supplied with a predetermined voltage such as the common voltage Vcom. Alternatively, the storage capacitor $C_{ST}$ includes the pixel electrode 190 and an adjacent gate line called a previous gate line, which overlaps the pixel electrode 190 via an insulator.

For color display, each pixel uniquely represents one of primary colors (i.e., spatial division) or each pixel sequentially represents the primary colors in turn (i.e., temporal division) such that spatial or temporal sum of the primary colors are recognized as a desired color. An example of a set of the primary colors includes red, green, and blue colors. FIG. 2 shows an example of the spatial division that each pixel includes a color filter 230 representing one of the primary colors in an area of the upper panel 200 facing the pixel electrode 190. Alternatively, the color filter 230 is provided on or under the pixel electrode 190 on the lower panel 100.

One or more polarizers (not shown) are attached to at least one of the panels 100 and 200.

Referring to FIGS. 1 and 2, the gray voltage generator 800 is disposed on the data PCB 550 and it generates two sets of gray voltages related to the transmittance of the pixels. The gray voltages in one set have a positive polarity with respect to the common voltage Vcom, while those in the other set have a negative polarity with respect to the common voltage Vcom.

The gate driver 400 includes a plurality of integrated circuit (IC) chips mounted on the respective gate TCPs 410. The gate driver 400 is connected to the gate lines G1-Gn of the panel assembly 300 and synthesizes the gate-on voltage Von and the gate off voltage Voff from an external device to generate gate signals for application to the gate lines G1-Gn.

The data driver 500 includes a plurality of IC chips mounted on the respective data TCPs 510. The data driver 500 is connected to the data lines D1-Dm of the panel assembly 300 and applies data voltages selected from the gray voltages supplied from the gray voltage generator 800 to the data lines D1-Dm.

According to another embodiment of the present invention, the IC chips of the gate driver 400 or the data driver 500 are mounted on the lower panel 100. According to further another embodiment, one or both of the drivers 400 and 500 are incorporated along with other elements into the lower panel 100. The gate PCB 450 and/or the gate TCPs 410 may be omitted in such embodiments.

The signal controller 600 controlling the drivers 400 and 500, etc. is disposed on the data PCB 550 or the gate PCB 450.

Now, the operation of the LCD will be described in detail with reference to FIGS. 1 to 3.

Referring to FIG. 1, the signal controller 600 is supplied with input image signals R, G and B and input control signals controlling the display thereof such as a vertical synchronization signal Vsync, a horizontal synchronization signal Hsync, a main clock MCLK, and a data enable signal DE, from an external graphics controller (not shown). After generating gate control signals CONT1 and data control signals CONT2 and processing the image signals R, G and B suitable for the operation of the panel assembly 300 on the basis of the input control signals and the input image signals R, G and B, the signal controller 600 provides the gate control signals CONT1 for the gate driver 400, and the processed image signals DAT and the data control signals CONT2 for the data driver 500.

The gate control signals CONT1 include a scanning start signal STV for instructing to start scanning and at least a clock signal for controlling the output time of the gate-on voltage Von. The gate control signals CONT1 may further include an output enable signal OE for defining the duration of the gate-on voltage Von.

The data control signals CONT2 include a horizontal synchronization start signal STH for informing of start of data transmission for a group of pixels, a load signal LOAD for instructing to apply the data voltages to the data lines $D_1$-$D_m$, and a data clock signal HCLK. The data control signal CONT2 may further include an inversion signal RVS for reversing the polarity of the data voltages (with respect to the common voltage Vcom).

Responsive to the data control signals CONT2 from the signal controller 600, the data driver 500 receives a packet of the image data DAT for the group of pixels from the signal controller 600, converts the image data DAT into analog data voltages selected from the gray voltages supplied from the gray voltage generator 800, and applies the data voltages to the data lines $D_1$-$D_m$.

The gate driver 400 applies the gate-on voltage Von to the gate line $G_1$-$G_n$ in response to the gate control signals CONT1 from the signal controller 600, thereby turning on the switching elements Q connected thereto. The data voltages applied to the data lines $D_1$-$D_m$ are supplied to the pixels through the activated switching elements Q.

The difference between the data voltage and the common voltage Vcom applied to a pixel is expressed as a charged voltage of the LC capacitor $C_{LC}$, i.e., a pixel voltage. The liquid crystal molecules have orientations depending on the magnitude of the pixel voltage.

The inverter 920 converts a DC voltage VIN from an external device into an AC voltage depending on a dimming control signal Vdim and supplies the AC voltage to the transforming unit 930. The transforming unit 930 boosts up the AC voltage and applied the boosted voltages to the lamp unit 910 to turn on/off the lamp unit 910, thereby controlling the luminance of the lamp unit 910.

In the meantime, the current sensor 940 detects the current flowing in the transforming unit 930 and supplies a signal containing the current information to the inverter 920. The inverter 920 controls the voltage supplied to the transforming unit 930 based on the current information, which will be described later in detail.

The light from the lamp unit 910 passes through the LC layer 3 and experiences the change of its polarization. The change of the polarization is converted into that of the light transmittance by the polarizers.

By repeating this procedure by a unit of the horizontal period (which is denoted by "1H" and equal to one period of the horizontal synchronization signal Hsync and the data enable signal DE), all gate lines $G_1$-$G_n$ are sequentially supplied with the gate-on voltage Von during a frame, thereby applying the data voltages to all pixels. When the next frame starts after finishing one frame, the inversion control signal RVS applied to the data driver 500 is controlled such that the polarity of the data voltages is reversed (which is referred to as "frame inversion"). The inversion control signal RVS may be also controlled such that the polarity of the data voltages flowing in a data line in one frame are reversed (for example, line inversion and dot inversion), or the polarity of the data voltages in one packet are reversed (for example, column inversion and dot inversion).

Now, a transforming unit according to an embodiment of the present invention will be described in detail with reference to FIG. 4.

Figure 4:
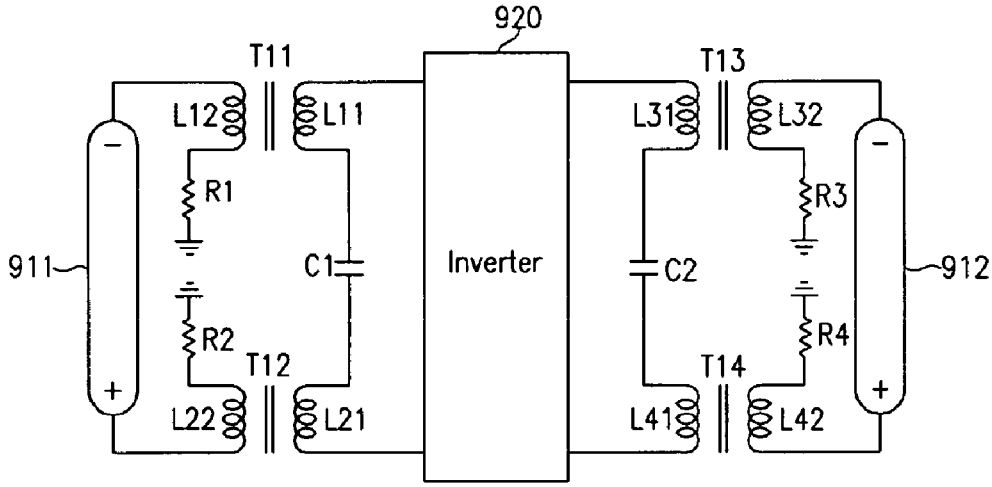
FIG. 4 is a circuit diagram of a transforming unit according to an embodiment of the present invention.

FIG. 4 is a circuit diagram of a transforming unit according to an embodiment of the present invention.

Referring to FIG. 4, a transforming unit according to this embodiment includes two pairs of transformers T11, T12, T13 and T14 connected to respective lamps 911 and 912. Each of the transformers T11, T12, T13 and T14 includes a primary coil L11, L21, L31, or L41 and a secondary coil L12, L22, L32 or L42. The primary coils L11 and L21 of the transformers T11 and T12 are connected to each other via a capacitor C1, and the primary coils L31 and L41 of the transformers T13 and T14 are connected to each other via a capacitor C2. The secondary coil L12, L22, L32 or L42 of each transformer T11, T12, T13 or T14 has a terminal connected to a grounded resistor R1, R2, R3 and R4. The lamp 911 is connected between other terminals of the secondary coils L12 and L22 of the transformers T11 and T12, and the lamp 912 is connected between other terminals of the secondary coils L32 and L42 of the transformers T13 and T14.

The inverter 920 applies AC voltages to the primary coils L11, L21, L31 and L41 of the transformers T11-T14 and AC currents are induced in the secondary coils L12, L22, L32 and L42. The induced voltages in the secondary coils L12, L22, L32 and L42 are applied to the lamps 911 and 912. At this time, the voltages applied to the transformers T11 and T12 have a phase opposite those applied to the transformers T13 and T14.

The current induction in the secondary coils L12, L22, L32 and L42 is detected by the resistors R1-R4 that serve as the current sensor 940. The inverter 920 receives current information from the resistors R1, R2, R3 and R4 to control the voltages applied to the transformers T11, T12, T13 and T14 such that the luminance of the lamps 911 and 912 is uniform. The capacitors C1 and C2 are resonant capacitors and block DC components.

In this way, adjacent lamps 911 and 912 are supplied with driving voltages having inverted phases (referred to as "inversion driving" hereinafter) to generate electromagnetic fields canceling each other, thereby reducing the electromagnetic interference. Accordingly, the image quality of the LCD is improved.

Then, an LCD according to another embodiment of the present invention will be described with reference to FIGS. 5-7.

Figure 5:
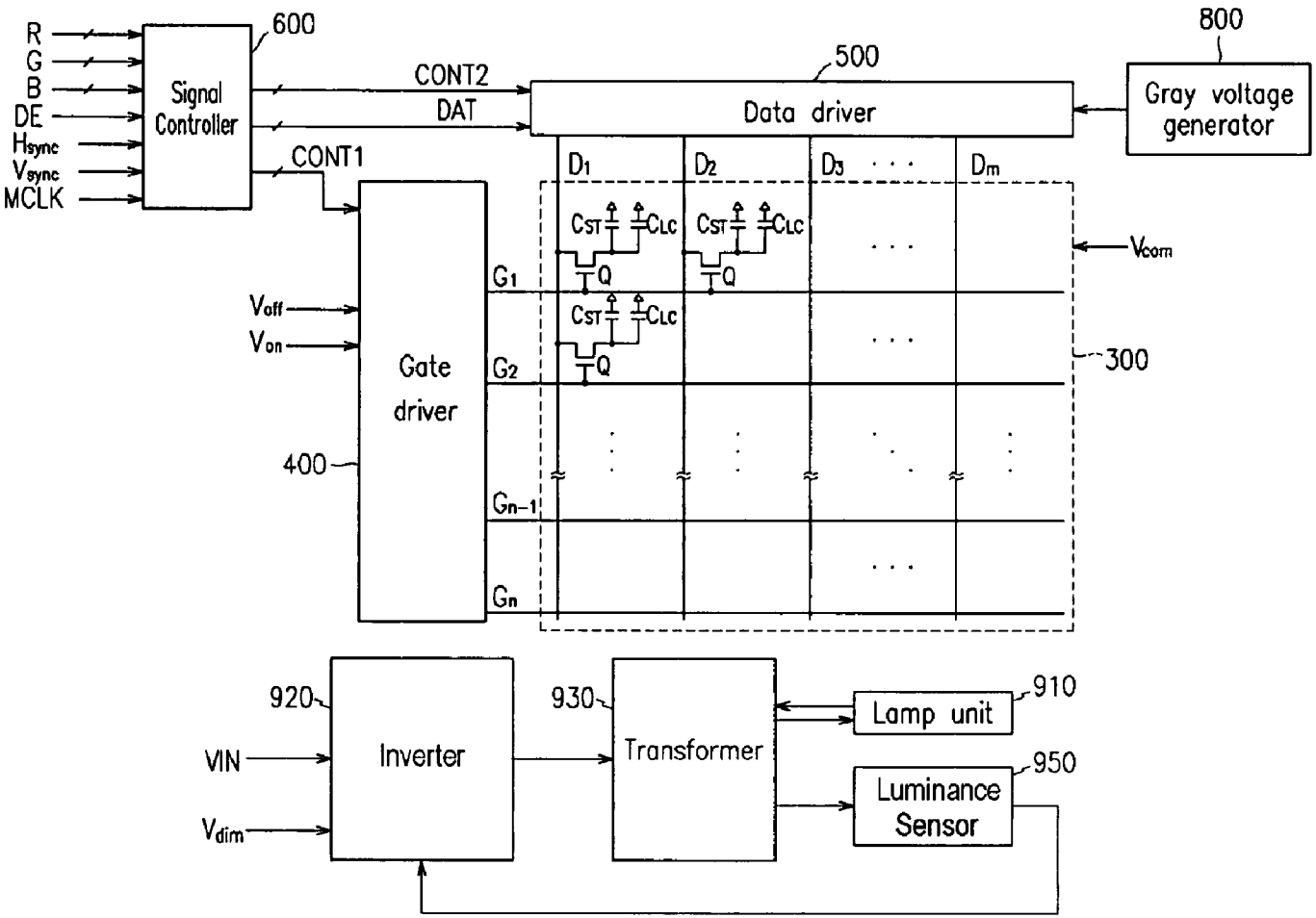
FIG. 5 is a block diagram of an LCD according to another embodiment of the present invention.

FIG. 5 is a block diagram of an LCD according to another embodiment of the present invention.

Like the LCD shown in FIG. 1, an LCD shown in FIG. 5 includes a display panel assembly 300, a gate driver 400, a data driver 500, a signal controller 600, a gray voltage generator 800, a lamp unit 910, an inverter 920, and a transforming unit 930.

Unlike the LCD shown in FIG. 1, the LCD shown in FIG. 5 includes a luminance sensor 950 instead of a current sensor.

The luminance sensor 950 is provided preferably under the lamps 341, particularly under centers of the lamps 341. A plurality of luminance sensors may be provided. The luminance sensor 950 generates an output signal depending on the luminance of the lamps 911 and 912 and supplies the output signal to the inverter 920. The inverter 920 controls the voltages supplied to the transforming unit 930 based on the output signal from the luminance sensor 950.

The luminance-based control can reflect the actual state of the lamps 911 and 912 including the defect of the lamps 911 and 912 such as lighting off and partial lighting of the lamps 911 and 912 and the luminance variation due to circumferential temperature or the reduction of lifetime.

Now, transforming units adaptable to the LCD shown in FIG. 5 win be described in detail with reference to FIGS. 6 and 7.

Figure 6:
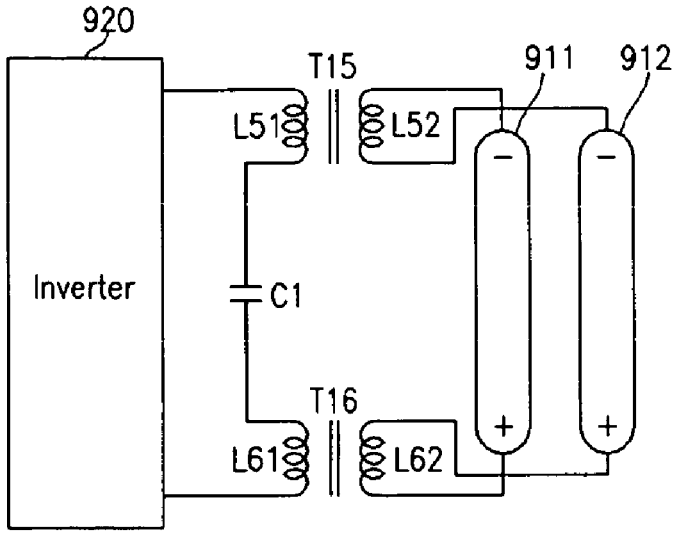
FIGS. 6 and 7 are block diagrams of transforming unit according to other embodiments of the present invention.
Figure 7:
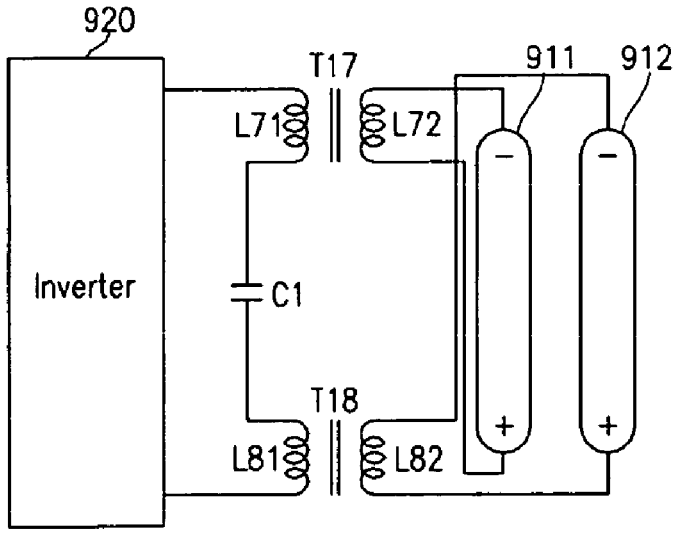

FIGS. 6 and 7 are block diagrams of transforming unit according to other embodiments of the present invention.

Each of transforming units shown in FIGS. 6 and 7 includes two transformers T15 and T16 or T17 and T18 connected to an inverter 920. The transformers T15 and T16 or T17 and T18 include primary coils L51 and L61 or L71 and L81 connected to the inverter 920 and connected to each other via a capacitor C1.

Referring to FIG. 6, the transformer T15 includes a secondary coil L52 having two terminals each connected to one end of the lamps 911 and 912 and the transformer T16 includes a secondary coil L62 having two terminals each connected to the other end of the lamps 911 and 912.

Referring to FIG. 7, the transformer T17 includes a secondary coil L72 having two terminals connected across one of the lamps 911 and 912 and the transformer T18 includes a secondary coil L82 having two terminals connected across the other of the lamps 911 and 912.

This configuration enables a reduction of the number of transformers while maintaining the above-described inversion driving of the lamps 911 and 912, thereby reducing the manufacturing cost and increasing the spatial margin.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. A device for driving a plurality of lamps, the device comprising:

a transforming unit which has at least two transformers and supplies driving voltages having inverted phases to adjacent lamps; and an inverter which controls the transforming unit, wherein each of the lamps comprise an external electrode fluorescent lamp (EEFL), each of the transformers has a primary coil connected to the inverter and a secondary coil connected to the lamps, and two terminals of the secondary coil are connected to different lamps.

2. The device of claim 1, wherein the inverter supplies voltages having inverted phases to the first and the second transformers.

3. The device of claim 1, wherein the primary coils of the first and the second transformers are connected to each other via a capacitor.

4. The device of claim 1, further comprising a luminance sensor which detects a luminance of the lamps and which provides luminance information for the inverter.

5. A device for driving a plurality of lamps, the device comprising:

a transforming unit which has at least four transformers and supplies driving voltages having inverted phases to adjacent lamps; and an inverter which controls the transforming unit, wherein each of the lamps comprise external electrode fluorescent lamp (EEFL), each of the transformers has a primary coil connected to the inverter and a secondary coil connected to the lamps, a lamp is connected to two different secondary coils and wherein a first two primary coils corresponding to two secondary coils connected to the first lamp and a second two primary coils corresponding to two secondary coils connected to the second lamp are connected to the inverter in parallel.

6. The device of claim 5, wherein the at least four transformers comprise:

a first transformer including a primary coil connected to the inverter and a secondary coil connected to a first lamp;

a second transformer including a primary coil connected to the inverter and a secondary coil connected to a second lamp;

a third transformer including a primary coil connected to the inverter and a secondary coil connected to the first lamp; and a fourth transformer including a primary coil connected to the inverter and a secondary coil connected to the second lamp, wherein the secondary coils of the first to the fourth transformers are connected to a ground via resistors.

7. The device of claim 6, wherein the primary coils of the first and the third transformers are connected to each other via a first capacitor and the primary coils of the second and the fourth transformers are connected to each other via a second capacitor.

8. The device of claim 5, further comprising a current sensor which detects a current flowing in the transforming unit and which provides current information for the inverter.

9. The device of claim 8, wherein the current sensor comprises a plurality of first to fourth resistors.

10. The device of claim 9, wherein the transforming unit comprises:

a first transformer including a primary coil connected to the inverter and a secondary coil having a first terminal connected to a first lamp and a second terminal connected to the first resistor;

a second transformer including a primary coil connected to the inverter and a secondary coil having a first terminal connected to the first lamp and a second terminal connected to the second resistor;

a third transformer including a primary coil connected to the inverter and a secondary coil having a first terminal connected to a second lamp and a second terminal connected to the third resistor;

a fourth transformer including a primary coil connected to the inverter and a secondary coil having a first terminal connected to the second lamp and a second terminal connected to the fourth resistor;

a first capacitor connected to the primary coils of the first and the second transformers; and a second capacitor connected to the primary coils of the third and the fourth transformers.

11. The device of claim 9, wherein the first to the fourth resistors have grounded terminals.

12. A liquid crystal display, comprising:

a plurality of pixels arranged in a matrix;

a plurality of lamps, which supplies light to the pixels based on driving voltages, and comprises a first lamp and a second lamp;

a transforming unit which has at least four transformers and supplies the driving voltages having inverted phases to adjacent lamps;

an inverter which controls the transforming unit; and a current sensor which detects a current which flows in the transforming unit and which provides current information for the inverter, wherein each of the lamps comprise an external electrode fluorescent lamp (EEFL), each of the transformers has a primary coil connected to the inverter and a secondary coil connected to the lamps, a lamp is connected to two different secondary coils and wherein a first two primary coils corresponding to two secondary coils connected to the second lamp are connected to the inverter in parallel.

13. A liquid crystal display, comprising:

a plurality of pixels arranged in a matrix;

a plurality of lamps which supplies light to the pixels based on driving voltages;

a transforming unit which has at least two transformers and which supplies the driving voltages having inverted phases to adjacent lamps;

an inverter which controls the transforming unit; and a luminance sensor which detects a luminance of the lamps and which provides luminance information for the inverter, wherein each of the lamps comprise an external electrode fluorescent lamp (EEFL), each of the transformers has a primary coil connected to the inverter and a secondary coil connected to the lamps, and two terminals of the secondary coil are connected to different lamps.

14. The liquid crystal display of claim 13, wherein the luminance sensor is disposed opposite the pixels with respect to the lamps.

15. The liquid crystal display of claim 14, wherein the luminance sensor are disposed near a center of the lamps.

* * * * *